US007679576B2

(12) United States Patent
Riedel et al.

(10) Patent No.: US 7,679,576 B2
(45) Date of Patent: Mar. 16, 2010

(54) ANTENNA ARRANGEMENT, IN PARTICULAR FOR A MOBILE RADIO BASE STATION

(75) Inventors: Matthias Riedel, Stephanskirchen (DE); Stephen John Saddington, Vogtareuth (DE)

(73) Assignee: Kathrein-Werke KG, Rosenheim (DE)

( * ) Notice: Subject to any disclaimer, the term of this patent is extended or adjusted under 35 U.S.C. 154(b) by 229 days.

(21) Appl. No.: 11/882,085

(22) Filed: Jul. 30, 2007

(65) Prior Publication Data

US 2008/0036674 A1 Feb. 14, 2008

(30) Foreign Application Priority Data

Aug. 10, 2006 (DE) ..... 10 2006 037 517

(51) Int. Cl.
*H01Q 19/10* (2006.01)
*H01Q 9/16* (2006.01)

(52) U.S. Cl. ..... 343/818; 343/797; 343/810

(58) Field of Classification Search ..... 343/797, 343/798, 810, 816, 872, 878, 818
See application file for complete search history.

(56) References Cited

U.S. PATENT DOCUMENTS

| | | | | |
|---|---|---|---|---|
| 5,710,569 | A | 1/1998 | Oh et al. | |
| 6,025,812 | A | 2/2000 | Gabriel et al. | |
| 6,930,651 | B2 * | 8/2005 | Gottl et al. | 343/872 |
| 6,933,906 | B2 * | 8/2005 | Stolle et al. | 343/797 |
| 6,985,123 | B2 | 1/2006 | Gottl | |
| 7,132,995 | B2 * | 11/2006 | Gottl | 343/797 |
| 7,427,966 | B2 * | 9/2008 | Boss et al. | 343/797 |
| 7,439,927 | B2 * | 10/2008 | Lenart et al. | 343/797 |
| 2005/0237258 | A1 | 10/2005 | Abramov et al. | |

FOREIGN PATENT DOCUMENTS

| | | | |
|---|---|---|---|
| DE | 196 27 015 | A1 | 1/1998 |
| DE | 197 22 742 | A1 | 12/1998 |
| DE | 101 50 150 | A1 | 5/2003 |
| DE | 697 25 874 | T2 | 8/2004 |
| DE | 103 59 622 | A1 | 7/2005 |
| EP | 09 916 169 | B1 | 5/1998 |
| EP | 1 057 224 | B1 | 12/1999 |
| EP | 0 939 975 | B1 | 10/2003 |
| EP | 1 588 454 | B1 | 3/2004 |
| WO | WO 99/62138 | | 12/1999 |
| WO | WO 00/39894 | | 7/2000 |
| WO | WO01/41256 | A1 | 6/2001 |
| WO | WO 2004/091041 | A1 | 10/2004 |
| WO | WO 2004/100315 | A1 | 11/2004 |
| WO | WO 2005/060049 | A1 | 6/2005 |

* cited by examiner

*Primary Examiner*—Douglas W Owens
*Assistant Examiner*—Chuc D Tran
(74) *Attorney, Agent, or Firm*—Nixon & Vanderhye PC

(57) ABSTRACT

An improved antenna arrangement comprises at least a dipole-shaped radiator arrangement with the associated carrying device and/or balancing device and the associated dipole and/or radiator halves as well as the reflector or the part reflector or the reflector frame which are formed from a common part, and the material of this common part is electrically conductive or is provided with an electrically conductive surface or surface layer if it consists of a dielectric material.

22 Claims, 5 Drawing Sheets

ANTENNA ARRANGEMENT, IN PARTICULAR FOR A MOBILE RADIO BASE STATION

CROSS-REFERENCES TO RELATED APPLICATIONS

Figure 1:
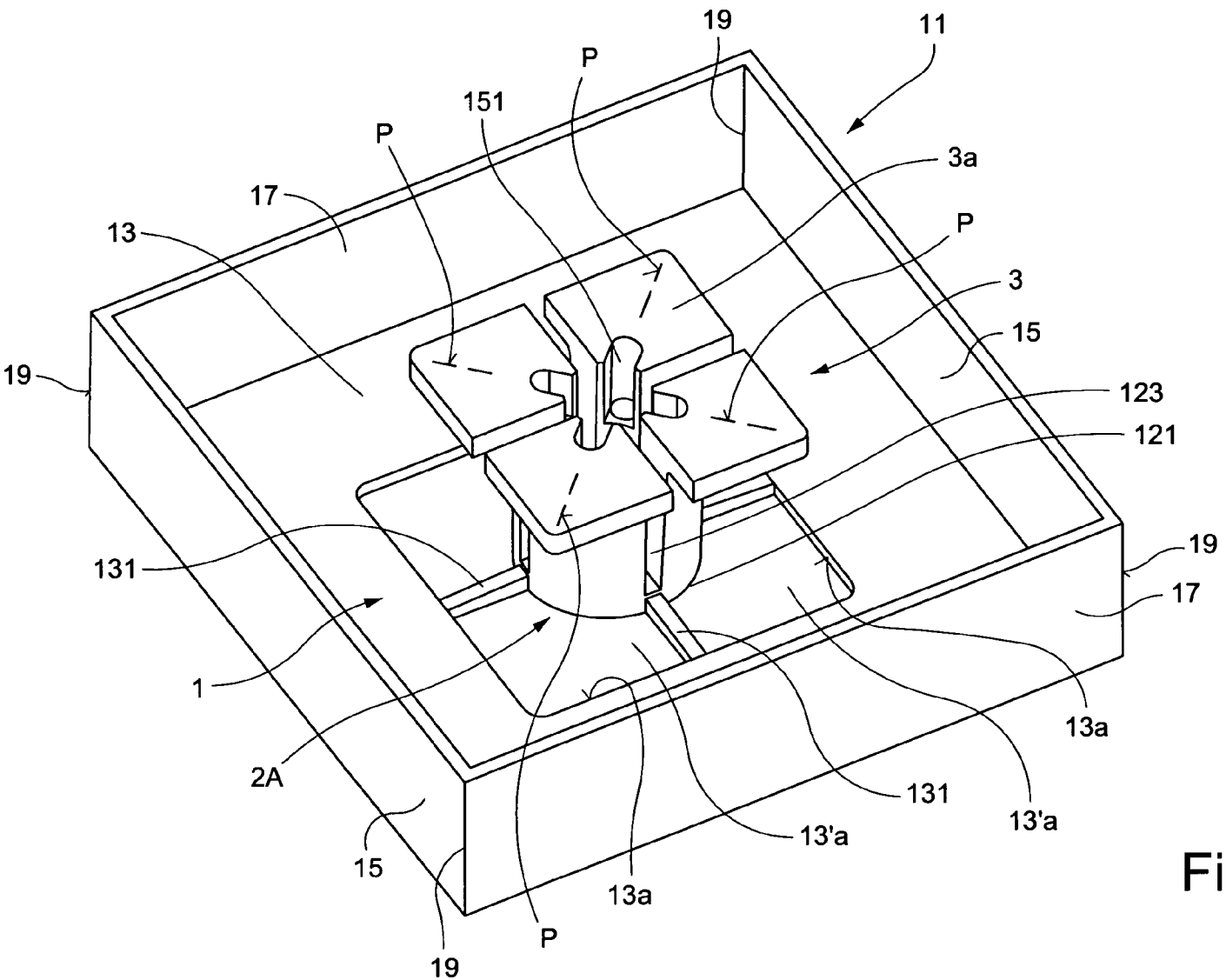

This application claims foreign priority benefits under 35 U.S.C. 119 of German Patent Application 10 2006 037 517.3 filed on Aug. 10, 2006.

The invention relates to an antenna arrangement, in particular for a mobile radio base station, according to the preamble of claim 1.

Antenna arrangements, in particular for a mobile radio base station, are known, for example, from WO 00/039894 A1. In this prior publication, a vertically alignable reflector is described, on the two outer lateral limitations of which running vertically and parallel with respect to one another, a lateral web projecting in the radiation direction and therefore transverse to the reflector plane is configured, in each case. Arranged one above each other in the vertical direction are a plurality of dipole arrangements which radiate in two polarization planes aligned perpendicularly with respect to one another and which consist of so-called vector dipoles. These vector dipoles are structurally similarly designed to dipole squares. The design and the feed are, however, such that, despite the horizontally or vertically aligned dipoles, the dipole arrangement as a whole acts as an X-polarized antenna, in which the two polarization planes which are perpendicular with respect to one another are aligned at an angle of +45° or −45° with respect to the vertical or the horizontal.

It can be inferred from WO 2005/060049 A1, that the dual-polarized radiators, which are seated in front of a reflector, can be provided with a capacitive outer conductor coupling. Introduced in each half of the two balancing devices located rotated about 90° with respect to one another are therefore axial bores extending perpendicularly to the reflector plane, in the region of which, rod-shaped coupling elements 21 galvanically connected to the reflector are seated and are surrounded by cylindrical insulators, on which the pairs of balancing halves, which are provided with the total of four axial bores and arranged rotated about 90° with respect to one another, of the dual-polarized radiator arrangement can be mounted. An inner conductor for feeding the two polarizations of the radiator arrangement located perpendicularly with respect to one another can be laid inside two rod-shaped coupling elements from the rear side of the reflector.

A radiator arrangement is also known from EP 1 588 454 B1. According to this prior publication, the use, for example, of a vertically alignable antenna arrangement with a reflector is described, on the vertical lateral limiting lines of which two lateral webs projecting transversely and, in particular, perpendicularly to the reflector plane in the direction of radiation are configured, between which the dual-polarized radiators arranged in the vertical direction above one another are seated. According to this prior publication, the base of the balancing device of the associated radiator arrangement is also capacitively connected (in other words without any electric/galvanic contact) to the reflectors, or coupled thereto, with the interposition of a base, for which purpose the reflector has a recess, in which the non-conductive base engages and is anchored and in turn holds the balancing device or the base of the balancing device of the dual-polarized radiator. The inner conductor can be laid here as described in the above-mentioned prior art.

Finally, antenna arrangements with reflectors are known, on the longitudinal lateral regions of which, in other words on the longitudinal or vertical lateral regions thereof, webs projecting forward from the reflector plane are provided, as can be inferred, for example, from the prior publications WO 99/62138 A1, U.S. Pat. No. 5,710,569 A or EP 0 916 169 B1.

In an alternative embodiment according to this prior publication, it is shown that, instead of an electrically conductive reflector, generally in the form of a metal sheet, a printed circuit board can also be used, on which the reflector is constructed. In this case, the electrically conductive ground face is preferably omitted on one side of the printed circuit board or the base is also provided with insulation in this region.

It is to be inferred as known from WO 2004/091041 A1 that a reflector for a radiator arrangement is not constructed, for example, from a plurality of sheet-metal parts, but may consist of a cast part, a deep drawn part, a stamped part or a milled part. In this case, the reflector produced in this manner may also be configured at least with an additionally integrated functional part, which is integrally connected to the reflector. This functional part may be one or more housing parts for HF components.

It is described how, for example, a housing attachment is produced integrally with the reflector on the reflector rear, in which housing attachment feed lines for the feeding of radiators arranged on the front can be accommodated.

It is an object of the invention, proceeding from the generic prior art according to WO 2004/091041 A1, to provide an antenna arrangement, in which the risk of the occurrence of intermodulation products is as low as possible. In this case, the production-related outlay for assembly is also to be as low as possible. The object is achieved according to the invention according to the features disclosed in claim 1. Advantageous configurations of the invention are given in the sub-claims. The invention provides an improved antenna arrangement which can be produced simply and with high precision with exactly predetermined radiation properties, avoiding potential sources of interference, such as, for example, undesired intermodulations.

The antenna arrangement according to the invention is distinguished in that the at least one radiator arrangement and an associated reflector or at least an associated reflector frame are produced together, in particular are cast, in other words consist of a common part or, for example, cast part. The entire antenna arrangement preferably comprises at least one radiator arrangement and the reflector or part reflector or a reflector frame which are formed from a common diecast part, in particular a metal diecast part, such as, for example, an aluminum cast part. It is also possible to cast the entire arrangement from a dielectric material, in particular plastics material, and then to provide it with a metallized, i.e. electrically conductive surface.

In particular when the antenna arrangement is produced from metal with regard to its important parts, in other words, for example, with the mentioned radiator arrangement (in other words, for example, the dipole and/or radiator halves and the associated carrying or balancing device and the associated reflector or a part reflector), other production methods can also be considered, for example production by deep drawing, milling or the like. In other words, the important parts of the antenna arrangement of this type, comprising the radiator arrangement with the associated carrying device and/or balancing device and the associated reflector or associated reflector part, consist of a part produced together which can also be called one-part or integral. Frequently a so-called "primary forming method" is also referred to for parts produced in this manner.

In the framework of an antenna arrangement of this type according to the invention, the reflector arrangement may also at least comprise a longitudinal and/or transverse web.

If the antenna arrangement according to the invention is used, in particular, as a base station for a mobile radio antenna, it generally comprises, when erected in a vertical orientation, a plurality of radiator devices arranged one above the other at a spacing, so a uniformly cast antenna of this type according to the invention with a plurality of radiators and/or radiator arrangements and the cast reflector or reflector frame comprises two lateral longitudinal webs extending in the vertical direction (which may be arranged located at a lateral edge or located offset thereto rather toward the centre). Furthermore, the antenna arrangement according to the invention may, however, also comprise an upper and a lower transverse web. If a plurality of radiator arrangements are arranged offset with respect to one another in the mounting direction, transverse webs may also be configured running between them in each case which are also cast integrally with the entire antenna arrangement. An entire antenna arrangement of this type may thus be produced as a uniform cast part which can be handled.

In a preferred embodiment, the radiator arrangement cast with the reflector or the reflector frame may also consist of dual-polarized radiator arrangements which radiate in two polarization planes which are perpendicular with respect to one another. In this case, cruciform dipole radiators could be used but also so-called vector dipoles, as are basically known from WO 00/039894 A1.

In a preferred embodiment, vector dipoles are used, as known from WO 2004/100315 A1, in which namely the radiator halves belonging to each polarization plane, arranged diagonally with respect to one another and, viewed alone in plan view, formed so as to be square or similar to a square, can be configured with a closed part face or even closed over the whole face.

In a preferred embodiment, it is also provided here that in the region of these dipole or radiator halves, corresponding recesses are provided in the region of the reflector plane. Namely, in the region of the slots separating the individual dipole halves or radiator halves from one another, which pass into recesses of the balancing device or carrying device carrying the radiator device, holding webs or holding connections may preferably be provided located in the reflector plane, via which the radiator arrangement seated in the centre is held by the reflector frame surrounding it.

The embodiment mentioned last also offers the advantage that a corresponding tool can also be used which, during the casting process, has an upper face limiting the cavity, which forms the lower face of the respective dipole half or radiator half. This tool can then be withdrawn downwardly, in other words with the transverse component to the reflector plane through the corresponding window-like recess, the entire radiator arrangement being held by the holding webs mentioned or holding connection portions, via which the radiator arrangement is connected with the reflector surrounding it.

In particular when a reflector is formed without longitudinal and/or transverse webs, there would also be the possibility of removing tools laterally with a withdrawal movement parallel to the reflector plane during demolding, so the reflector plane could then also be closed.

In a reflector formed in this manner, the base of the balancing device of the radiator arrangement may be connected galvanically, i.e. in terms of direct current, to the reflector plane.

The dual-polarized radiator arrangement and the associated reflector frame may be formed as a whole from an electrically conductive material. The radiator arrangement and the reflector frame may, however, also be formed from a plastics material or in general dielectric material, i.e. cast, the corresponding parts then being provided with an electrically conductive surface layer. In this case, it is not necessary, however, for example, for the above-mentioned holding webs or holding connections between the carrying device and the radiator device and the reflector frame to also be electrically conductive. In other words, the radiator device and, in particular, its carrying device and/or the balancing device and the reflector frame may be galvanically separated from one another.

The antenna arrangement according to the invention with a reflector arrangement preferably comprising a plurality of radiators and a reflector frame with longitudinal and/or transverse webs may, however, also be capacitively coupled to a ground face or capacitively coupled to a ground face arranged below the so-called reflector frame.

It has previously been conventional in the prior art, to generally use reflectors made of a metal sheet, on which the radiator modules are constructed. Owing to the radiators arranged between the lateral outer limitation of the reflector plane and the radiators generally arranged rather to the centre, it was possible to configure at a suitable point the longitudinal lateral limitations projecting transversely to the reflector plane in the form of longitudinal webs which could be adjusted, for example, between a perpendicular alignment with respect to the reflector plane through to an angled alignment in such a way that a desired radiation shaping was possible.

If, on the other hand, it was desired to use reflectors in the form of printed circuit boards (so-called PCBs), which were provided on one printed circuit board side with an electrically conductive ground face, this required that the webs required for the radiation formation had to be connected to the ground face of the printed circuit board by means of screw or solder connections in order to produce a clear galvanic connection here. This assembly work was, however, not only laborious but constantly caused potential intermodulation sources of interference.

In contrast, it is now proposed, proceeding from a printed circuit board which is preferably provided on the radiator side with an electrically conductive ground face and an insulating layer located thereabove, building on this, to position the reflector frame with the radiator arrangement connected thereto, which reflector frame is provided with a coupling face parallel to the ground face of the printed circuit board, longitudinal and/or transverse webs required for the pattern formation then being configured in turn on this coupling face. In other words, a capacitive reflector frame coupling is preferably proposed which makes it possible to capacitively couple the longitudinal and/or transverse webs required for the pattern formation to a ground face seated on a printed circuit board.

In the scope of the invention, a capacitive coupling of the reflector frame is thus preferably provided on a printed circuit board without a galvanic connection between the reflector and printed circuit board ground face. The invention is distinguished by a stable intermodulation-free connection. Above all, a precisely defined coupling between the ground face of the printed circuit board and the reflector frame can also be ensured in the scope of the invention by a clearly defined spacing and/or by a clearly definable size of the coupling faces.

Finally, a rapid and uncomplicated assembly is also possible in the scope of the invention, so fault sources are reduced and, above all, solder points on the reflector are omitted. If the uniformly cast antenna arrangement according to the invention consisting of the reflector frame and radiator module or radiator modules is used as the antenna arrangement, further assembly steps for connection to an additional printed circuit board, for example one provided with a ground face, would no longer be necessary at all. If a printed circuit board of this type provided with a ground face is used to produce a capacitive outer conductor coupling, a simple connection is possible, for example, by using an adhesive strip which adheres on both sides, in order to produce the reflector frame with the printed circuit board located therebelow and provided with a ground face with the formation of the total reflector with the capacitive outer conductor coupling.

The completely assembled unit, consisting of the reflector frame and the radiator arrangement connected thereto and the printed circuit board, forms a self-supporting unit. The reflector frame and the base of the radiator arrangement or the radiator arrangements may be fixed on the board with all suitable means, for example by means of clips, by means of an adhesive tape which adheres on both sides, separate adhesive etc.

The ground face is preferably provided on the printed circuit board by the producer with an insulating layer allowing a galvanic separation with respect to the reflector frame, for example in the form of a lacquer, in particular solder resist lacquer, a film or another plastics material layer. If the reflector frame is glued on by means of an adhesive tape adhering on both sides, an insulation and therefore a galvanic separation is through this produced between the electrically conductive reflector frame, on the one hand, and ground face on the printed circuit board, on the other hand, so a separate insulating layer on the ground face could even be dispensed with.

Figure 2:
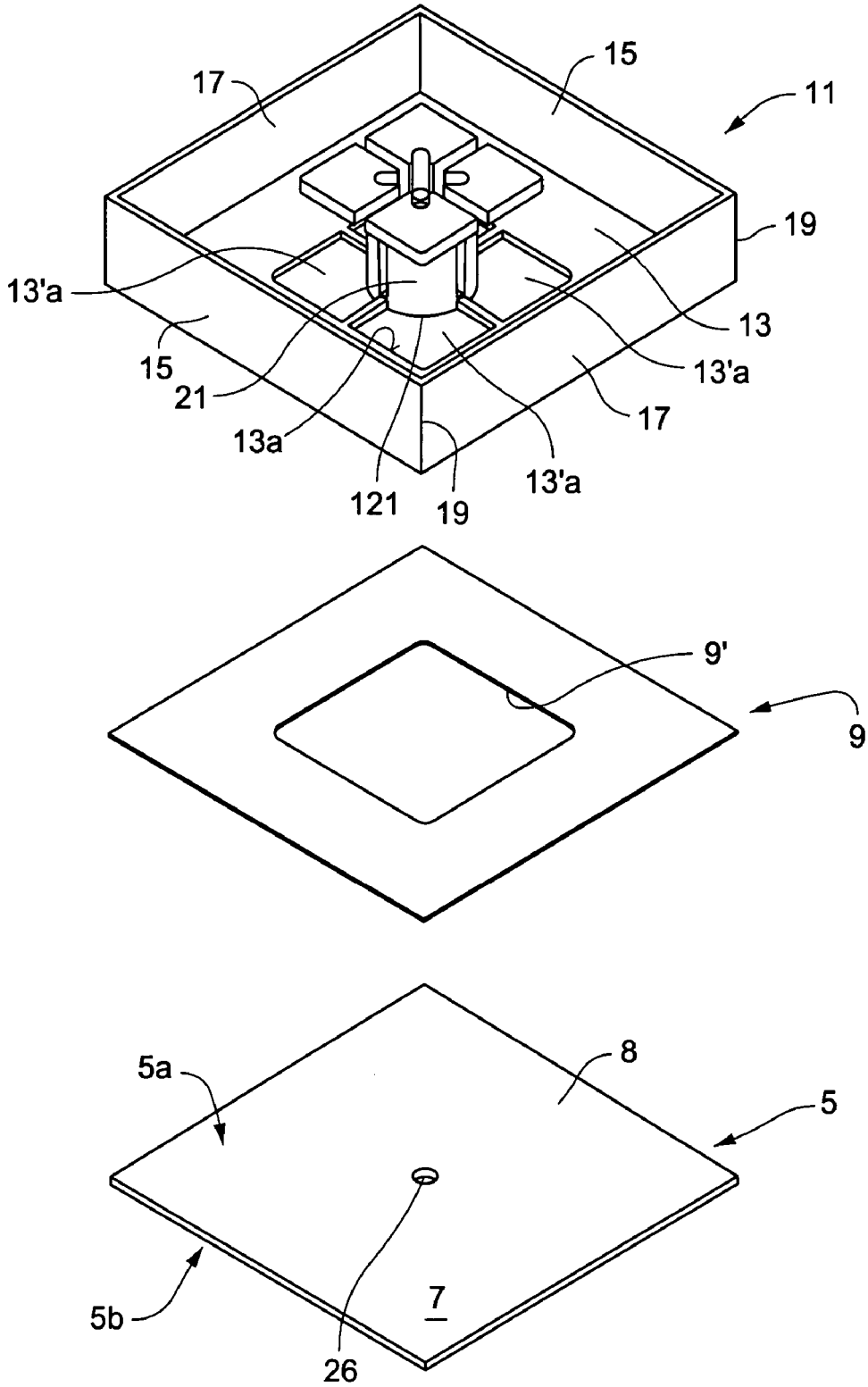
Figure 3:
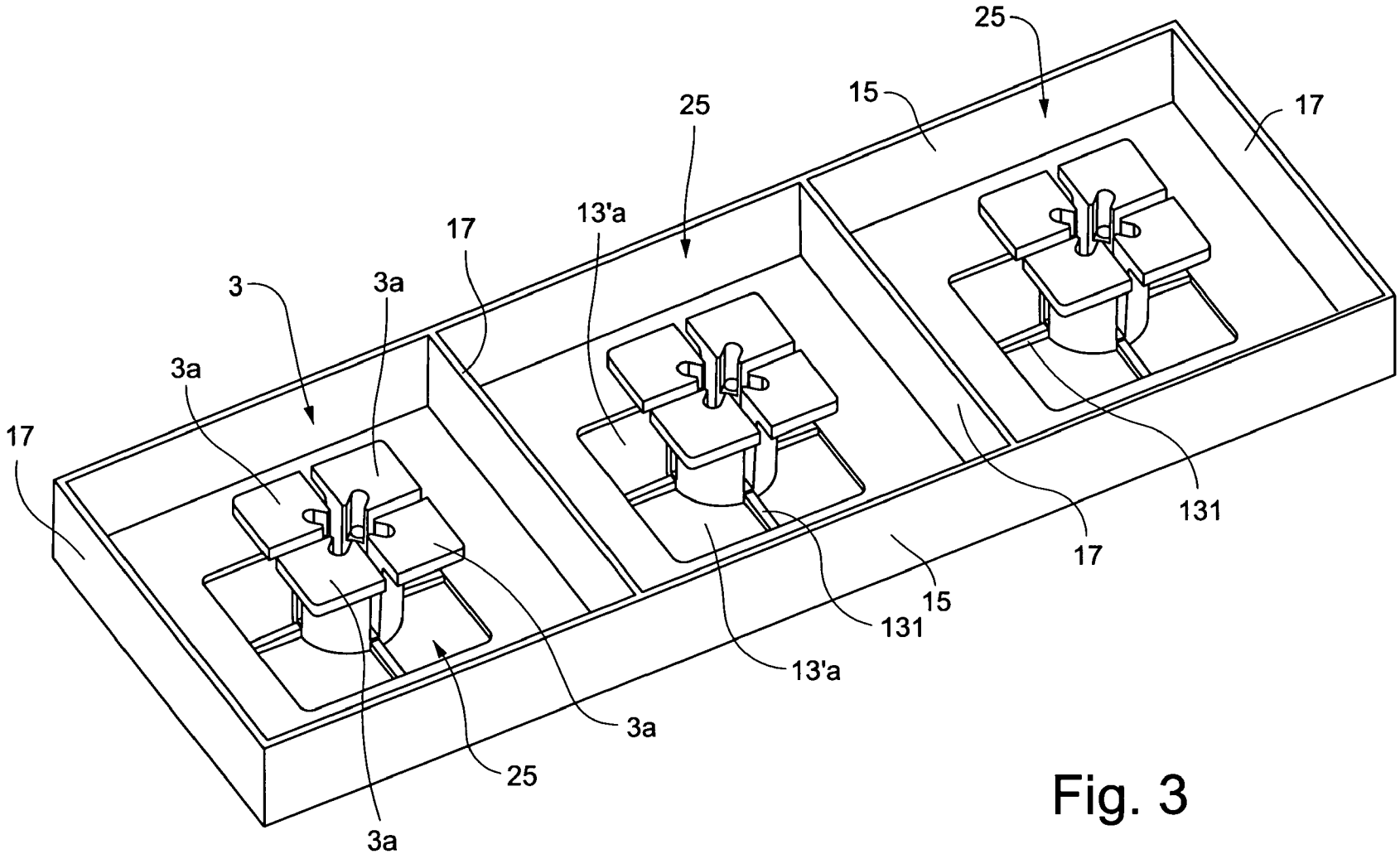
Figure 4:
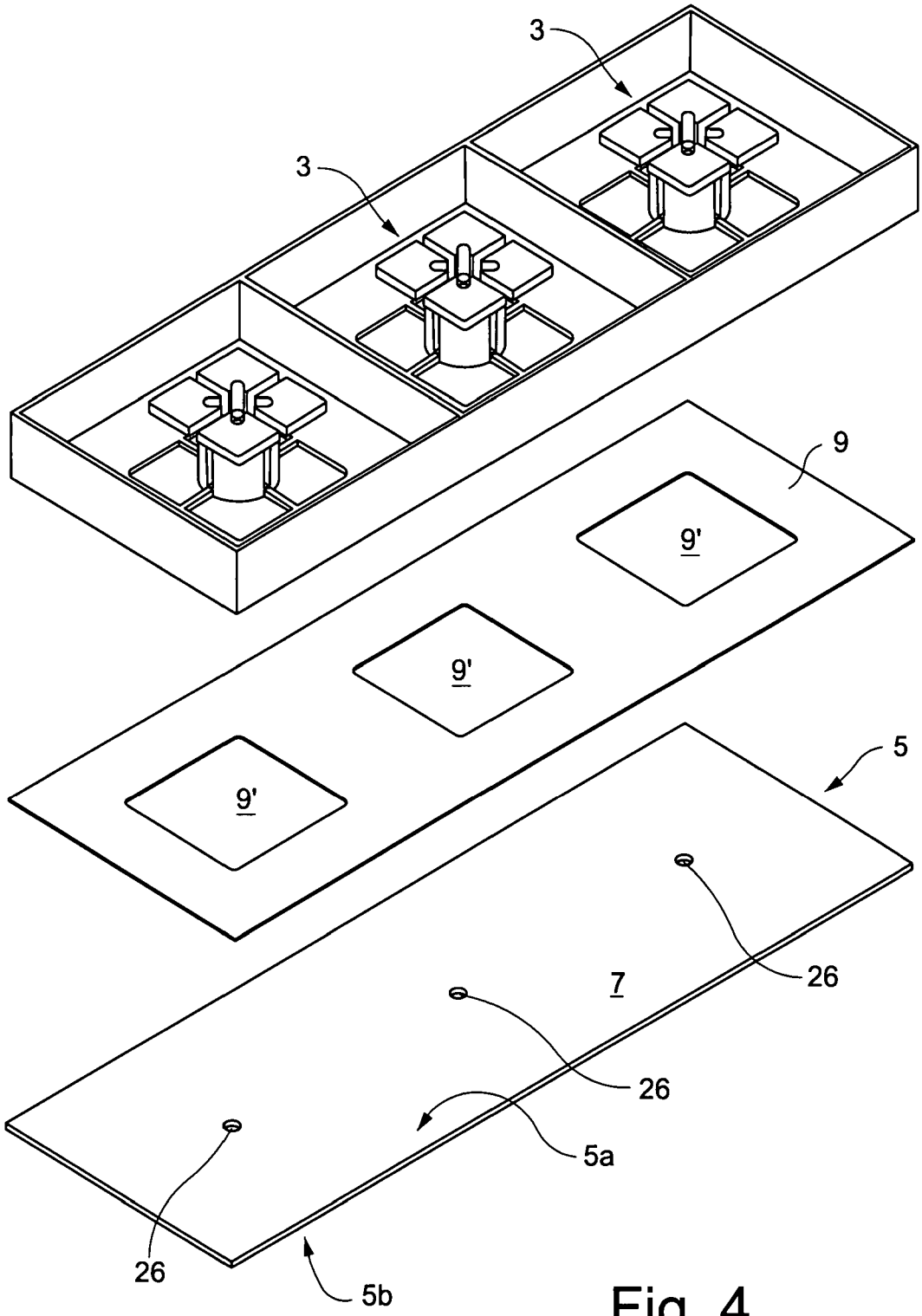
Figure 5:
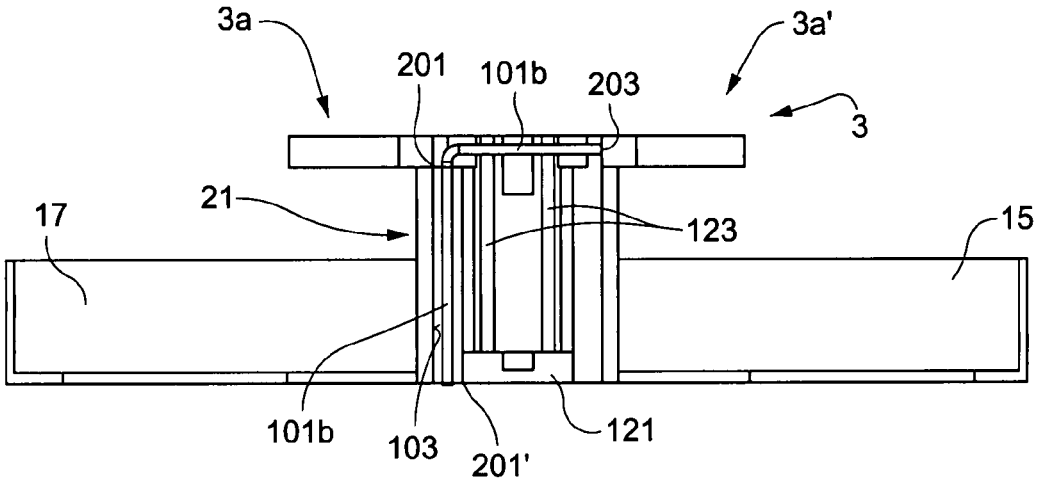
Figure 6:
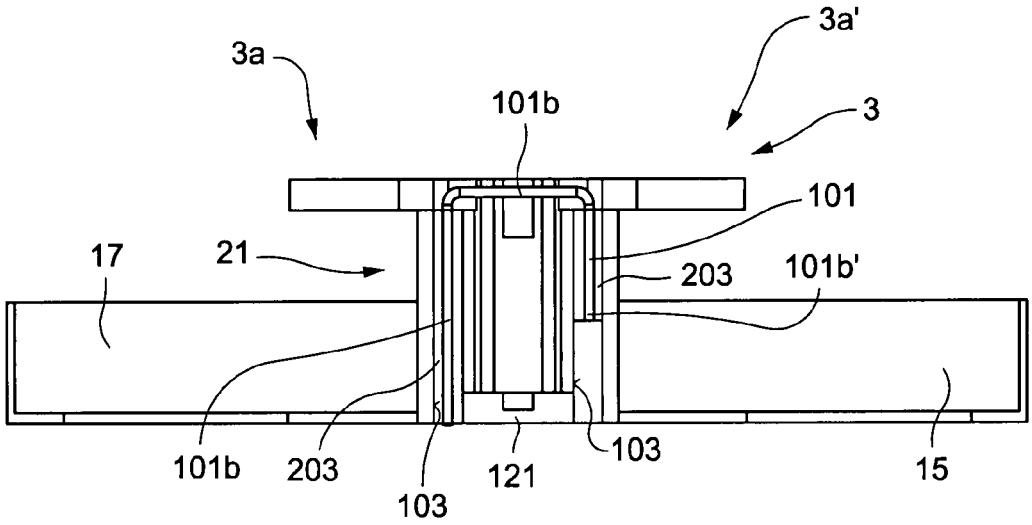

Further advantages, details and features of the invention emerge below from the embodiments described in the figures, in which, in detail:

FIG. 1: shows a schematic three-dimensional view of a basic type of an antenna according to the invention with a dual-polarized radiator arrangement;

FIG. 2: shows an exploded view of the embodiment of FIG. 1;

FIG. 3: shows a corresponding schematic three-dimensional view of an antenna arrangement according to the invention with three dual-polarized radiators arranged offset with respect to one another;

FIG. 4: shows an exploded view of the embodiment of FIG. 3;

FIG. 5: shows a schematic cross sectional view through a dual-polarized radiator with a part of the reflector arrangement to clarify the feeding of the radiator; and FIG. 6: shows an embodiment modified with respect to FIG. 5.

FIG. 1 shows the basic type of an antenna arrangement according to the invention as can be used, for example, for a mobile radio base station. The antenna arrangement comprises a reflector arrangement 1, in front of which a dual-polarized radiator or a dual-polarized radiator arrangement 3 is provided. In the embodiment shown, this is a vector dipole, which radiates in two polarization planes P which are perpendicular with respect to one another and which are perpendicular to the reflector plane and run virtually diagonally through the corners of the radiator arrangement which is square in plan view. With regard to the construction and mode of functioning of such a radiator type, reference is made, for example, to WO 00/039894 A1.

However, any radiator or radiator type can basically be used in the scope of the invention, in particular dipole radiators and/or patch radiators, such as are known, for example, from the prior publications DE 197 22 742 A1, DE 196 27 015 A1, U.S. Pat. No. 5,710,569 A, WO 00/039894 A1 or DE 101 50 150 A1.

It can be inferred from the view according to FIG. 1 that the antenna arrangement has a so-called reflector or reflector frame 11. This reflector or reflector frame 11 comprises a reflector face 13 which will sometimes also be called a coupling face 13' below in view of an embodiment of the invention still to be described below. This reflector face 13 is provided, in the embodiment shown, with longitudinal webs 15 extending perpendicularly with respect to the reflector face 13 and transverse webs 17 which are configured and/or provided, in the embodiment shown, on the outer limitations of the reflector frame 11 but may also be located offset further inward relative to the outer limitations of the reflector frame 11, so a portion of the reflector projecting outwardly over the webs 15, 17 remains. These longitudinal and transverse webs 15, 17 are also connected to one another at the corner regions 19. The longitudinal and transverse webs shown do not absolutely necessarily have to be aligned perpendicularly to the reflector face 13. These webs may also partially extend in an alignment to the reflector face differing from a 90° angle, for example diverging in the radiation direction or running toward one another or may be more inclined to the left or the right etc. To this extent, limitations basically do not exist.

It can also be seen from the view according to FIG. 1 that the reflector face 13 is provided with a recess 13*a* which, in the embodiment shown, has dimensions in the longitudinal and transverse direction that are as large as the dual-polarized radiator 3 with regard to its longitudinal and/or transverse extension. The cut-out face with the formation of the corresponding recess 13*a* may be shaped in any way here, i.e. it may differ from the outer contour of the radiator and even comprise curved edge courses, so the recess 13*a* thus formed is defined by curved section courses or any other limitation lines.

It can also be seen from the view according to FIG. 1 that the two balancing devices 21 arranged rotated about 90° with respect to one another (one balancing device for each polarization of the radiator device 3) have a base 121 located at the bottom in FIG. 1 connecting them together, from which upwardly extending so-called balancing slots 123 are provided. To this extent, a carrying device 21 for the dipoles or radiators or dipole or radiator halves etc. is primarily also referred to below, the carrying device comprising corresponding slots 123 extending axially from the top in the direction of the base 121.

The antenna arrangement according to the invention is distinguished according to one embodiment in that the at least one radiator arrangement and an associated reflector or at least one associated reflector frame are cast together, in other words consist of a common cast part. The entire antenna arrangement preferably comprises at least one radiator arrangement and the reflector or the part reflector or a reflector frame which are formed from a common cast part, in particular a diecast part, such as, for example, a metal diecast part or an aluminum cast part. It is also possible to cast the entire arrangement from a dielectric material, in particular plastics material and to then provide it with a metallized, i.e. electrically conductive surface.

As can also be seen from FIG. 1, the window-like recess 13*a* provided in the reflector plane of the reflector frame 11, in other words at the level of the reflector face 13, is substantially square in plan view. In this case, this window-like square configuration is divided into four part openings 13'*a*, namely by holding webs 131 which in each case extend from the base 121 of the carrying device and/or balancing device 21 centrally and transversely, i.e. in particular perpendicularly to the side limitations of the window cut-out and are cast during the casting process of the antenna arrangement together with the radiator arrangement and the reflector frame 11. The carrying device and/or balancing device 21 and therefore the entire radiator arrangement 3 is connected to the reflector frame 11 and therefore held by this total of four holding webs 131.

The width of the holding webs 131 corresponds to the slot width of the slots 123 in the carrying device and/or balancing device 21, via which the dipole or radiator halves 3*a* located at the top are held. The thickness of the holding webs 131 can be selected as desired. Thus, the thickness of the holding webs 131 may, for example, correspond to the thickness of the coupling faces 13 or else to the thickness of the base 121 of the carrying device and/or balancing device 21, i.e. the carrying device 21.

In the embodiment shown, the slots 123 reach approximately to the surface of the coupling faces 13 or the surface of the holding webs 131 but may also end thereabove.

The reflector frame 11 is preferably produced together with the entire radiator arrangement 3 from an electrically conductive material, for example from a metal cast part (aluminum, but also other materials may be considered for this). This may also be a plastics material part which is then metallized, in other words covered with a metallic conductive surface. In particular when producing the reflector frame 11 from metal, other production methods may be considered, for example production of the reflector frame by deep drawing, milling, or the like. In other words, the antenna arrangement with the reflector arrangement 3 and the reflector or reflector frame may also be produced by other production methods as a common part, for example by milling, optionally by deep drawing etc. Frequently, a so-called "primary forming method" is referred to here.

A configuration of the antenna arrangement with the above-mentioned holding webs 131 and the slots 123 and the described window-like recesses 13'*a* has the advantage that a casting tool can be used, for example, that has cruciform walls which, once the casting process is complete in the drawing according to FIG. 1, can be removed upwardly perpendicular to the reflector face, whereby the cruciform separating and balancing slots and the inner further recesses 151 (which are required to lay feed cables here) can be removed upwardly, whereas another part of the casting tool can be removed downwardly through the four part window recesses 13'*a*. Only if at least transverse and/or longitudinal webs were to be dispensed with, could a tool of this type also be removed laterally, i.e. parallel to the coupling face plane 13, so the window-like recesses 13*a* could then be dispensed with at the level of the coupling faces 13.

An antenna arrangement formed in this manner is fully functional per se, once the corresponding cabling, in particular for feeding the radiator arrangement, has been installed. In this case, a uniform, handleable, mechanically rigidly connected overall arrangement consisting of a dipole radiator (a dual-polarized dipole radiator in the embodiment shown) and a reflector frame is formed, in this case, by the antenna arrangement described with the aid of FIG. 1.

In contrast to this, this antenna arrangement may also be further completed, namely with an additional ground face producing the overall reflector, which is formed on a substrate.

For this purpose, reference is made to the exploded view according to FIG. 2.

As emerges, in particular from the exploded view with regard to a preferred development of the invention according to FIG. 2, the antenna arrangement may also comprise a printed circuit board 5 (PCB), which is preferably provided on the side 5*a* facing the radiator side, the so-called radiator or ground face side 5*a*, with a preferably all-over electrically conductive ground face 7. The electric components and the conductor paths connecting the electric components are then provided on the opposing conductor path plane 5*b* (in other words on the lower side of the printed circuit board 5 not shown in more detail with respect to FIGS. 1 and 2).

The ground face 7 is generally covered with an insulating layer 8 not reproduced in FIG. 2, for example in the form of a plastics material or film layer, a lacquer layer or so-called solder resist lacquer layer etc.

The antenna arrangement described with the aid of FIG. 1 with the radiator arrangement 3 and the reflector frame 11 can be rigidly connected to the printed circuit board 5, specifically by any measures suitable for this. The two parts can be assembled, for example, by fixing a screw to be screwed in from the rear side of the printed circuit board into the lower side, in other words the base 121 of the carrying device and/or balancing device 21 or by means of other clip-like fastening elements, the carrying device and/or balancing device 21, via which the radiator elements 3*a* of the dual-polarized radiator 3 are held, being capacitively coupled with the ground face 7 of the printed circuit board 5 located therebelow.

The reflector frame 11 could also be connected to the printed circuit board by means of suitable mechanical means. However, the reflector frame 11 is preferably fastened to the upper side of the printed circuit board 5 by means of an adhesive film 9 that adheres on both sides, the adhesive film 9 being provided, in the embodiment shown, with a window-like cut-out 9', the size and positioning of which corresponds or is approximated to the cut-out 13*a* in the coupling face 13 of the reflector frame 11. The adhesive film may also be continuous, however, in other words be provided without the above-mentioned window-like cut-out 9'. In this case, a corresponding adhesive film 9 provided with an adhesive layer on both sides or another spacer may also be provided on the lower side of the base 121 of the carrying device and/or balancing device 21, so the same spacing ratios and conditions are provided between the lower side of the coupling faces 13 and the lower side of the base 121 with respect to the ground face 7 of the printed circuit board 5 located therebelow and covered with an insulating layer.

If the insulating layer 8 on the ground face 7 should also be provided with a window, so the insulting layer 8 is omitted in the region of this window (with it being possible for this region, where the insulating layer 8 is omitted on the ground face, to be comparable with the size and/or arrangement of the other window 9' with regard to the double-sided adhesive device 9 and/or the recess 13*a* in the reflector face 13), the ground face 7 would in this region lie "bare". In this case, the base 121, in other words the lower side of the carrying device and/or balancing device 21, could also be galvanically contacted by the ground face 7. In the board, bores and axial bores flush therewith are configured in the base 121 of the carrying device and/or balancing device 21 of the radiator arrangements in order to guide an inner conductor being used for feeding upwardly from the rear side of the printed circuit board here, in each case, and to couple it galvanically via a bridge portion with the respective diagonally opposing second half 3*a* of the radiator device 3 located at the top or, to couple it inductively, as described in WO 2005/060049 A1, for example. Reference is therefore also made to this extent, with regard to the mode of functioning, to the above-mentioned prior publication or to the FIGS. 5 and 6 described later.

To ensure a rigid connection between the reflector face 13, in other words a rigid connection between the reflector frame 11, on the one hand, and the lower side of the base 121 of the radiator arrangement 3, on the other hand, with the printed circuit board, all conceivable connection methods may be considered. Thus, for example, an adhesive compound may be applied to the upper side of the printed circuit board (in other words the ground face or the insulating layer 9 covering the ground face) and/or to the lower side of the coupling face 13. However, clip-like parts which engage in one another and produce a catch mechanism when attached are also possible.

However, the above-mentioned adhesive tape 9 adhering on both sides, ensuring a rigidly predetermined spacing between the coupling face 13 and the ground face 7 and simultaneously producing a mechanically rigid connection, is preferred. The reflector frame 11 with the printed circuit board 5 is a rigidly connected self-supporting unit owing to a connection of this type.

Owing to the structure described, a capacitive coupling, which also ensures the desired capacitive coupling of the ground face for the longitudinal and/or transverse webs 15, 17, is produced by the capacitive coupling of the reflector face 13, which is therefore sometimes also called a coupling face 13', and of the ground face 7 located therebelow on the printed circuit board 5.

With the aid of FIG. 3, only one extension is reproduced such that the corresponding antenna arrangement may also comprise a plurality of radiator arrangements 3 seated next to one another or above one another in the mounting direction, an antenna arrangement of this type being erected with the plurality of radiators generally in the vertical direction, so the plurality of radiator arrangements are arranged spaced apart one above the other in a vertical plane. The reflector frame may, in this case, comprise a number of reflector fields 25 corresponding to the number of radiator arrangements. The size of the antenna arrangement can thus be extended as desired. In this case, the adhesive tape 9 which adheres on the two sides is preferably configured so as to be a corresponding length and provided with three recesses 9' which correspond to the three recesses or windows 13*a* with the respective four part windows 13'*a* in the three reflector fields 25 of the reflector frame 11. This radiator arrangement may also be additionally fixed through the bore 26 incorporated in the printed circuit board (see FIG. 2 or 4), similarly to in the embodiment according to FIG. 3, from below by screwing a screw into the base of the carrying device and/or balancing device of the radiator device 13, preferably using an electrically non-conductive screw, above all when the base of the carrying device and/or balancing device of the radiator device 3 is to be capacitively coupled to the ground face 7 of the printed circuit board 5. However, a film adhering on both sides comparable with the adhesive tape 9 adhering on both sides is preferably also provided on the lower side of the base 121, so the lower side of the base 121 and the lower side of the coupling faces 13 are seated at the same spacing level with respect to the upper side of the printed circuit board 5 located therebelow.

With the aid of FIGS. 5 and 6, it is only indicated by a schematic section through a corresponding radiator arrangement how a feed of a dual-polarized radiator or, in a similar manner, also of a singly-polarized radiator 3 can take place.

The feed generally takes place by means of a coaxial cable which extends from the lower side of the reflector through an axial bore 103 leading in the carrying device or balancing device 21 to the plane of the actual dipole and/or radiator halves 3*a*. At the upper end of this axial bore at the level of the dipole and/or radiator halves 3*a*, the coaxial cable is then stripped, so the outer conductor, which is insulated in the axial bore 103 relative to the carrying and/or balancing device 21, is exposed and is then electrically/galvanically connected in the upper region, for example, by means of a solder 201 to the inner end of an associated dipole or radiator half 3*a*. Substantially, only the inner conductor 101*b* is drawn in here in FIG. 5 in the drawings. The coaxial cable would thus be passed upwardly from below through the axial bore 103, the outer conductor, as mentioned, then being electrically/galvanically connected to the associated dipole or radiator half 3*a* at the upper end of the carrying device 21 via the solder 201. Up to this point, the outer conductor is insulated relative to the carrying device 21.

Alternatively or preferably, however, a coaxial feed cable would be connected in such a way that the outer conductor is held at the lower end of the bore 103, for example, on a solder point 201' and the inner conductor 101*b* is held only by an insulator and guided upwardly separately in the bore 103. The bore in the carrying device thus acts as an outer conductor which surrounds the inner conductor 101*b*, so a coaxial feed line is virtually formed as a result, via which the dipole and/or radiator halves which are electrically/galvanically conductively connected to the carrying device, generally as a common component, are fed.

If the one dipole half (which is not fed by the inner conductor) is not fed by an electrical/galvanic coupling, for example in the region of the bore of the carrying device, but, for example, by soldering on an outer conductor of a coaxial cable, the corresponding feed may also be brought about capacitively, for example by a capacitive coupling between the base of the carrying device and the ground or reflector face. Generally, the associated feed line, usually the outer conductor of a coaxial cable, is thus connected in a region below the carrying device, which is preferably located, with a plan view perpendicular to the reflector, in that region below the dipole or radiator half which is fed thereby.

The inner conductor 101*b* generally connected to the inner conductor of a coaxial cable, is generally angled approximately at the level of the dipole and/or radiator halves 3*a* by 90° or approximately 90° and leads to the adjacent inner end of the associated second dipole and/or radiator half 3*a* and is generally contacted there electrically by means of a solder 203.

In the case of a dual-polarized radiator, the feed of the dipole and/or radiator halves 3*a* located offset with respect to one another by 90° takes place accordingly, the second inner conductor extending crosswise with respect to the first inner conductor 101*b* being arranged on another plane, so the two inner conductors do not touch in the middle but are guided past one another.

In a singly-polarized radiator with only one polarization plane, only one feed conductor also designated an inner conductor is required.

In the embodiment according to FIG. 6, it is shown that the end 101*b'* of the inner conductor 101*b* ends freely in a further axial bore 103, this further axial bore 103 being provided in the carrying device and/or balancing device 21. In this case, the freely ending end portion of the inner conductor 101*b* is guided downwardly over a certain axial length in this further bore 103 and thus held via an insulator 203 in the bore 103 (similarly to the corresponding insulator 203 for fixing the inner conductor 101*b* in the other axial bore 103), so a capacitive or serial coupling is produced here with regard to the second dipole and/or radiator half 3*a'*.

Other feeds are also possible.

It is mentioned only for the sake of completeness that it can, for example, also be seen from FIGS. 5 and 6 that the slots 23 extend here to the lower plane or base 121 of the carrying and/or balancing device 21. The level of this carrying and/or balancing device 21 or the slots 123 should preferably lie in a range of about ⅛ to ⅜ of a wavelength from the relevant operating frequency band to be transmitted or received; the level should preferably thus be ⅛ to ⅜ based on the medium wavelength λ of the frequency band to be transmitted or received, in other words preferably about ¼ λ. In general, therefore, the radiator level relative to the reflector, in other words relative to the ground or reflector face should not fall below a value of λ/10, with there basically being no upward restriction, so the radiator level could even be any multiple of λ. The slots 123 can then be adapted accordingly with respect to their length.

The invention claimed is:

1. An antenna arrangement comprising:

at least one dipole-shaped radiator arrangement, the dipole-shaped radiator arrangement comprising a carrying device and associated radiator halves, a reflector arrangement having an electrically conductive reflector face, the reflector arrangement comprising at least a part of a reflector and plural holding webs electrically and mechanically rigidly connected thereto, the at least one dipole-shaped radiator arrangement with the associated carrying device and the associated radiator halves as well as the reflector arrangement being formed from a common part, material of said common part being electrically conductive or provided with an electrically conductive surface, the reflector arrangement defining a recess, in the region of which, transversely and perpendicularly to the plane of the reflector arrangement, the carrying device of the dual-polarized radiator arrangement extends, and the carrying device is mechanically rigidly and electrically connected with the plural holding webs arranged offset in a direction that is peripheral to the reflector arrangement surrounding the recess.

2. The antenna arrangement as claimed in claim 1, wherein:

the carrying device is mechanically rigidly connected at its base with said plural holding webs arranged offset in the direction that is peripheral to the reflector arrangement surrounding the recess.

3. The antenna arrangement as claimed in claim 1, wherein the dipole-shaped radiator arrangement with the associated carrying device and the associated radiator halves and the reflector are formed from a common part formed by the so-called primary forming method selected from casting, deep drawing, stamping or milling.

4. The antenna arrangement as claimed in claim 1, wherein the radiator arrangement comprises a singly-polarized dipole radiator.

5. The antenna arrangement as claimed in claim 1, wherein the radiator arrangement comprises a dual-polarized radiator arrangement consisting of a cross dipole, a dipole square, or a vector dipole.

6. The antenna arrangement as claimed in claim 1, wherein the holding webs have a thickness which corresponds to the material thickness of the reflector arrangement.

7. The antenna arrangement as claimed in claim 1, further comprising balancing slots extending perpendicularly to the reflector plane and end close to or at the level of the holding webs.

8. The antenna arrangement as claimed in claim 7, wherein the holding webs are provided at the level of the base of the carrying device.

9. The antenna arrangement as claimed in claim 7, wherein, in an axial plan view of the radiator arrangement, the holding webs are arranged in a linear extension of the at least one carrying device.

10. The antenna arrangement as claimed in claim 1, wherein the reflector arrangement comprises a printed circuit board having a printed circuit board side on which an electrically conductive ground face is provided, the reflector arrangement comprises a reflector face which extends parallel to the printed circuit board ground face and is used as a coupling face, the coupling face has the recess, via which the ground face located therebelow is not covered, and the at least one radiator arrangement is positioned on the printed circuit board in the region of the recess.

11. The antenna arrangement as claimed in claim 10, wherein the reflector arrangement comprises at least one web which rises transverse to the plane of the reflector face and is a component of the common part.

12. The antenna arrangement as claimed in claim 11, wherein the reflector arrangement comprises at least one of two longitudinal webs and two transverse webs.

13. The antenna arrangement as claimed in claim 11, wherein the reflector arrangement is connected to the printed circuit board by mechanical connection means.

14. The antenna arrangement as claimed in claim 13, wherein the reflector arrangement is rigidly connected to the printed circuit board by means of one of a clip, a latching device and a snap device.

15. The antenna arrangement as claimed in claim 11, wherein the reflector arrangement is bonded to the printed circuit board.

16. The antenna arrangement as claimed in claim 11, wherein the reflector arrangement is rigidly connected to the printed circuit board using an adhesive tape or film adhering on both sides thereof.

17. The antenna arrangement as claimed in claim 16, wherein the adhesive tape or film has a recess, the size and/or position of which corresponds at least to the size and/or the position of a corresponding recess.

18. The antenna arrangement as claimed in claim 17, wherein the adhesive tape or film is provided between the lower side of the reflector face and the ground face or an insulating layer covering the ground face and therebeyond in the region of the recess in the reflector face, also in the region between the base of the carrying device of the radiator arrangement and the ground face on the printed circuit board.

19. The antenna arrangement as claimed in claim 18, wherein a double-sided adhesive tape or film is also provided below the base of the carrying device of the radiator arrangement, via which the base of the carrying device is mechanically connected to the printed circuit board.

20. The antenna arrangement as claimed in claim 11, wherein a transverse web is provided between two radiator arrangements.

21. The antenna arrangement as claimed in claim 1, wherein a plurality of radiator arrangements are provided which are positioned at a spacing with respect to one another successively in a mounting direction.

22. The antenna arrangement as claimed in claim 1, wherein one radiator device is arranged per recess in a coupling face.

* * * * *